US009324290B2

(12) United States Patent
Shin

(10) Patent No.: US 9,324,290 B2
(45) Date of Patent: Apr. 26, 2016

(54) LIQUID CRYSTAL DISPLAY (LCD) AND METHOD OF DRIVING THE SAME

(71) Applicant: Samsung Display Co., Ltd., Yongin, Gyeonggi-Do (KR)

(72) Inventor: Yong-Jin Shin, Asan-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 37 days.

(21) Appl. No.: 14/089,620

(22) Filed: Nov. 25, 2013

(65) Prior Publication Data

US 2014/0354625 A1 Dec. 4, 2014

(30) Foreign Application Priority Data

May 28, 2013 (KR) ..... 10-2013-0060471

(51) Int. Cl.
*G09G 3/36* (2006.01)

(52) U.S. Cl.
CPC ..... *G09G 3/3688* (2013.01); *G09G 3/3648* (2013.01); *G09G 2310/0251* (2013.01)

(58) Field of Classification Search
CPC ..... G09G 2310/0248; G09G 2310/0243; G09G 2310/0251; G09G 3/3688; G09G 3/3648
USPC ..... 345/87–103, 204, 208–210
See application file for complete search history.

(56) References Cited

U.S. PATENT DOCUMENTS 6,359,608 B1 * 3/2002 Lebrun et al. ..... 345/100
6,417,847 B1 * 7/2002 Mametsuka ..... G09G 3/3688 345/206
6,600,469 B1 * 7/2003 Nukiyama et al. ..... 345/87
7,301,518 B2 * 11/2007 Hosaka ..... 345/94
7,471,277 B2 * 12/2008 Sagawa et al. ..... 345/98
8,111,231 B2 * 2/2012 Sagawa et al. ..... 345/98
8,497,885 B2 * 7/2013 Ikeda et al. ..... 345/690
8,648,848 B2 * 2/2014 Tsai et al. ..... 345/212
2002/0041267 A1 * 4/2002 Jung ..... 345/92
2003/0080932 A1 * 5/2003 Konno et al. ..... 345/96
2003/0179221 A1 * 9/2003 Nitta et al. ..... 345/690
2003/0184572 A1 * 10/2003 Kaise ..... 345/698
2003/0206149 A1 * 11/2003 Yamashita ..... G09G 3/3614 345/92
2004/0041760 A1 3/2004 Tsumura et al.
2006/0028463 A1 * 2/2006 Nakamura et al. ..... 345/204
2006/0290611 A1 * 12/2006 Tsuge ..... G09G 3/3233 345/74.1

(Continued)

FOREIGN PATENT DOCUMENTS

KR 10-0445675 B1 12/2004
KR 10-2010-0048420 A 5/2010

(Continued)

*Primary Examiner* — Lun-Yi Lao
*Assistant Examiner* — Kelly B Hegarty
(74) *Attorney, Agent, or Firm* — Knobbe, Martens, Olson & Bear, LLP

(57) ABSTRACT

A liquid crystal display (LCD) and method of driving the same are disclosed. In one aspect, the LCD includes a display panel that includes a plurality of gate lines, a plurality of data lines, and a plurality of pixels each electrically connected to a corresponding gate line and a corresponding data line. The LCD also includes a timing controller that receives present frame data, stores previous frame data, and outputs first line data of the previous frame data and a data driver that converts the first line data to a first previous line data voltage and applies the first previous line data voltage to the data lines during a portion of a vertical blank period between a present frame and a previous frame.

22 Claims, 3 Drawing Sheets

(56) References Cited

U.S. PATENT DOCUMENTS

| | | | | |
|---|---|---|---|---|
| 2007/0046609 | A1* | 3/2007 | Lee | 345/94 |
| 2007/0132709 | A1* | 6/2007 | Kawaguchi | 345/102 |
| 2008/0259059 | A1* | 10/2008 | De Greef | 345/204 |
| 2010/0214276 | A1 | 8/2010 | Tanikame et al. | |
| 2010/0315403 | A1* | 12/2010 | Kaneyoshi | G09G 3/3614 345/211 |
| 2012/0127153 | A1* | 5/2012 | Yukawa | 345/215 |
| 2013/0021315 | A1 | 1/2013 | Kang | |

FOREIGN PATENT DOCUMENTS

| | | | |
|---|---|---|---|
| KR | 10-2011-0075413 | A | 7/2011 |
| KR | 10-2011-0076642 | A | 7/2011 |
| WO | WO 97/25706 | A1 | 7/1997 |

* cited by examiner

LIQUID CRYSTAL DISPLAY (LCD) AND METHOD OF DRIVING THE SAME

CROSS-REFERENCE TO RELATED APPLICATIONS

This U.S. non-provisional patent application claims priority under 35 U.S.C. §119 of Korean Patent Application No. 10-2013-0060471, filed on May 28, 2013, the contents of which are hereby incorporated by reference in its entirety.

BACKGROUND

1. Field

The described technology generally relates to a liquid crystal display (LCD) and a method of driving the same, and more particularly, to an LCD capable of pre-charging pixels and a method of driving the LCD.

2. Description of the Related Technology

LCDs generally include an LCD panel. The LCD panel typically includes a lower substrate, an upper substrate facing the lower substrate, and a liquid crystal layer interposed between the lower substrate and the upper substrate.

Generally, LCD panels include gate lines, data lines, and pixels connected to the gate lines and the data lines. A gate driver that sequentially outputs gate signals to the gate lines is typically directly formed on the LCD panel through a thin film process.

SUMMARY OF CERTAIN INVENTIVE ASPECTS

One inventive aspect is an LCD which is capable of pre-charging pixels connected to a first gate line.

Another aspect is a method of driving the LCD.

Another aspect is an LCD including a display panel, a timing controller, a data driver, and a gate driver.

The display panel includes a plurality of gate lines, a plurality of data lines, and a plurality of pixels each electrically connected to a corresponding gate line and a corresponding data line.

The timing controller receives present frame data, stores previous frame data, and outputs first line data of the previous frame data.

The data driver converts the first line data to a first previous line data voltage and applies the first previous line data voltage to the data lines during a portion of a vertical blank period between a present frame and a previous frame.

The gate driver applies a first gate signal configured to include a pre-charge voltage, a gate high voltage, and a gate low voltage to a first gate line of the gate lines. The pre-charge voltage is applied during a pre-charge period overlapping at least a part of the portion of the vertical blank period.

The gate high voltage is applied during a line period and the pre-charge period is a period prior to the line period. The pre-charge period is smaller than the portion of the vertical blank period. The gate high voltage and the pre-charge voltage are maintained in a high voltage state and the gate low voltage is maintained in a low voltage state during a rest period. The gate high voltage and the pre-charge voltage have the same voltage level.

The timing controller includes a frame memory, a pre-charge signal generator, and a pre-charge data output part. The frame memory stores the previous frame data. The pre-charge signal generator generates a pre-charge signal indicating an output timing of the first line data. The pre-charge data output part receives the pre-charge signal from the pre-charge signal generator and the first line data of the previous frame data from the frame memory.

The timing controller further includes a data compensator to generate compensation data on the basis of the previous frame data received from the frame memory and the present frame data.

Another aspect is a method of driving an LCD which includes a display panel having a plurality of gate lines and a plurality of data lines, a timing controller, a data driver, and a gate driver, including applying present frame data to the timing controller, storing a previous frame data in the timing controller, outputting first line data of the previous frame data from the timing controller, converting the first line data to a first previous line data voltage in the data driver, outputting the first previous line data voltage to the data lines during a portion of a vertical blank period between the present frame and the previous frame from the data driver, and applying a first gate signal configured to include a pre-charge voltage, a gate high voltage, and a gate low voltage to a first gate line of the gate lines from the gate driver, wherein the pre-charge voltage is applied during a pre-charge period overlapping at least a part of the portion of the vertical blank period.

According to at least one embodiment, the pixels connected to the first gate line may be pre-charged to the first previous line data voltage of the previous frame by the application of a pre-charge voltage to the first gate line.

BRIEF DESCRIPTION OF THE DRAWINGS

The above described and other advantages of the described technology will become readily apparent by reference to the following detailed description when considered in conjunction with the accompanying drawings.

DETAILED DESCRIPTION OF CERTAIN INVENTIVE EMBODIMENTS

Figure 1:
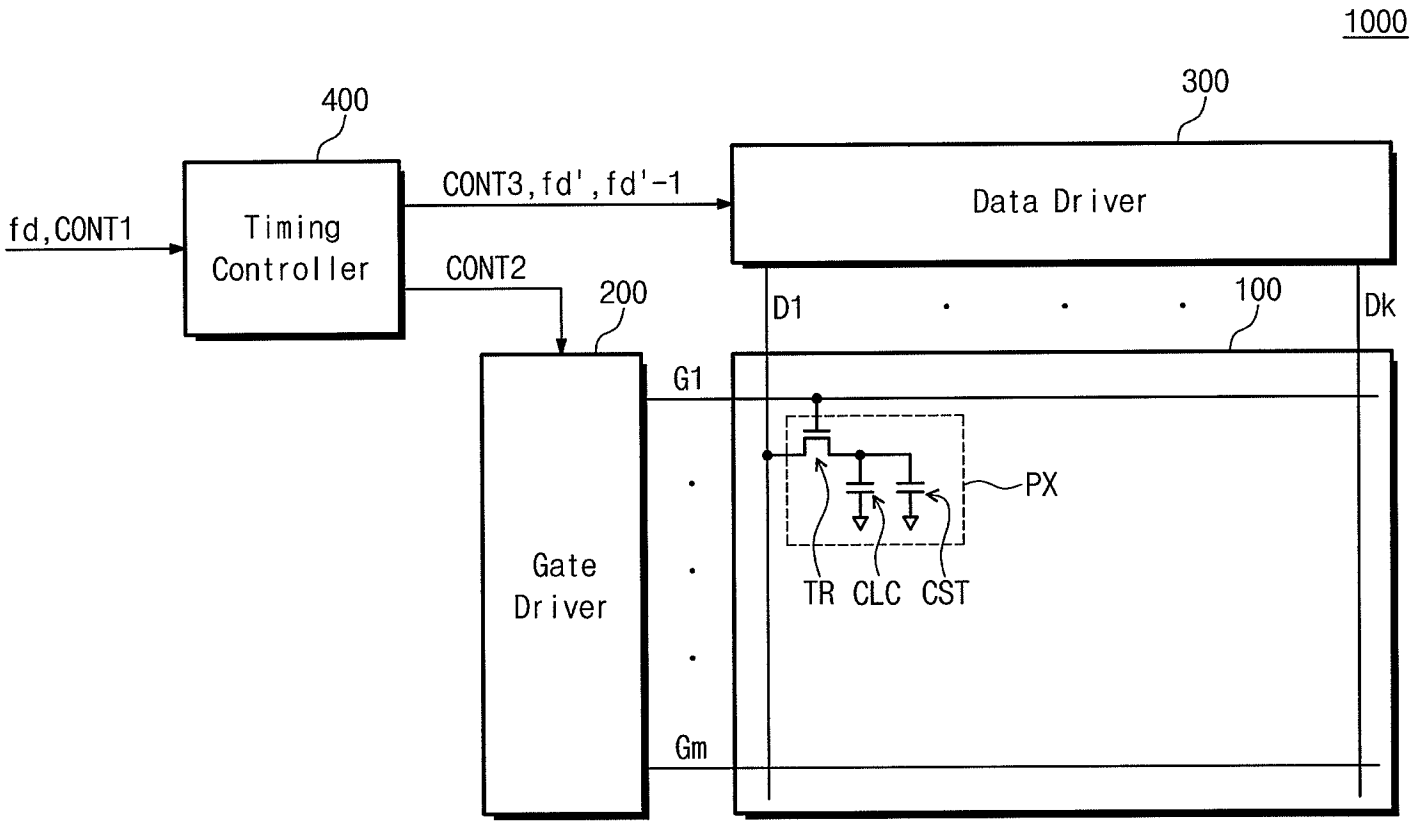
FIG. 1 is a block diagram showing an LCD according to an exemplary embodiment.

Gate lines are typically formed over the entire surface of an LCD panel. As LCD panels are increasingly manufactured to have larger sizes, the gate lines must be lengthened. Thus, the gate signals, e.g., a gate high voltage, can be distorted by the higher line resistance of longer lines. This distortion influences the length of time thin film transistors connected to the gate lines are turned on, and thus, the charge on pixel electrodes connected to the thin film transistors is reduced. As a result, data voltages provided from the data lines are not sufficiently applied to the pixel electrodes, and consequently, a desired image is not properly displayed on the LCD panel.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Throughout the specification, the term "connected" includes "electrically connected." Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another element, region, layer or section. Thus, a first element, component, region, layer or section discussed below could be termed a second element, component, region, layer or section without departing from the teachings of the described technology.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein should be interpreted accordingly.

The terminology used herein is for the purpose of describing particular embodiments only and is not intended to be limiting of the described technology. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which the described technology belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the described technology will be explained in detail with reference to the accompanying drawings.

FIG. 1 is a block diagram showing an LCD according to an exemplary embodiment.

Referring to FIG. 1, an LCD 1000 includes a display panel 100 which displays an image, gate and data drivers 200 and 300 which drive the display panel 100, and a timing controller 400 which controls the gate and data drivers 200 and 300.

The display panel 100 includes a plurality of gate lines G1 to Gm and a plurality of data lines D1 to Dk. The gate lines G1 to Gm are applied with gate signals and the data lines D1 to Dk are applied with data voltages. A plurality of pixel areas are defined in the display panel 100 by the gate lines G1 to Gm and the data lines D1 to Dk and a pixel PX is disposed in each pixel area. The pixel PX includes a thin film transistor TR, a liquid crystal capacitor CLC, and a storage capacitor CST.

The thin film transistor TR includes a gate electrode connected to a first gate line G1, a source electrode connected to a first data line D1, and a drain electrode connected in parallel to the liquid crystal capacitor CLC and the storage capacitor CST.

As an example, the display panel 100 may include a lower substrate, an upper substrate facing the lower substrate, and a liquid crystal layer interposed between the lower substrate and the upper substrate.

The gate lines G1 to Gm, the data lines D1 to Dk, the thin film transistor TR, and a pixel electrode that serves as a first electrode of the liquid crystal capacitor CLC may be disposed on the lower substrate. The thin film transistor TR is turned on in response to the gate voltage to apply the data voltage to the pixel electrode.

A common electrode that serves as a second electrode of the liquid crystal capacitor CLC may be disposed on the upper substrate and a common voltage is applied to the common electrode. The liquid crystal layer disposed between the pixel electrode and the common electrode serves as a dielectric substance. Accordingly, the liquid crystal capacitor CLC is charged with a voltage corresponding to an electric potential difference between the data voltage and the common voltage. However, the positioning of the pixel electrode and the common electrode is not limited to the above description. That is, the pixel electrode and the common electrode may be disposed on the lower substrate in accordance with the operating mode of the display panel.

The gate driver 200 is electrically connected to the gate lines G1 to Gm to apply the gate signals to the gate lines G1 to Gm. The data driver 300 is electrically connected to the data lines D1 to Dk to apply the data voltages to the data lines D1 to Dk.

The timing controller 400 receives a first control signal CONT1. The first control signal CONT1 includes various signals, e.g., a vertical synchronization signal, a horizontal synchronization signal, a main clock signal, a data enable signal, etc. The timing controller 400 outputs a gate control signal CONT2 and a data control signal CONT3 in accordance with the first control signal CONT1. Additionally, the timing controller 400 also receives present frame data fd including image information for each frame.

The gate control signal CONT2 is applied to the gate driver 200 to control the operation of the gate driver 200. The gate control signal CONT2 may include a vertical start signal instructing the start of the operation of the gate driver 200, a gate clock signal indicating the output timing of the gate signal, and an output enable signal indicating the pulse width of the high period of the gate signal.

The gate driver 200 outputs the gate signal including a pre-charge voltage, a gate high voltage, and a gate low voltage.

The data control signal CONT3 is applied to the data driver 300 to control the operation of the data driver 300. The data control signal CONT3 may include a horizontal start signal instructing the start of the operation of the data driver 300, an inverting signal instructing inversion of the polarity of the data voltage, and an output indicating signal indicating the output timing of the data voltage.

Figure 2:
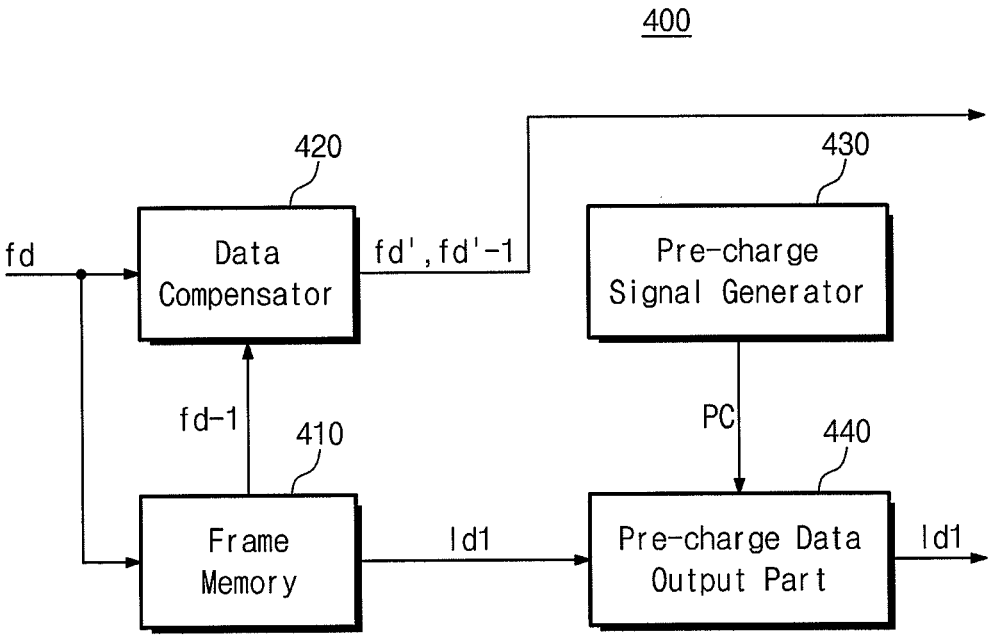
FIG. 2 is a block diagram showing the timing controller of FIG. 1.

FIG. 2 is a block diagram illustrating the timing controller of FIG. 1.

Referring to FIGS. 1 and 2, the timing controller 400 includes a frame memory 410, a data compensator 420, a pre-charge signal generator 430, and a pre-charge data output part 440.

The frame memory 410 receives and stores the present frame data fd. The present frame data fd is the image data for a specific frame. The present frame data fd stored in the frame memory 410 becomes the previous frame data after the period of one frame.

The data compensator 420 receives the present frame data fd and receives the previous frame data fd−1 from the frame memory 410. The data compensator 320 generates compensation data fd' and fd'−1 based on the present frame data fd and the previous frame data fd−1 and provides the compensation data fd' and fd'−1 to the data driver 300. The compensation data fd' and fd'−1 may include over drive data and normal data. The over drive data is obtained by adding a compensation value corresponding to a gray-scale difference between the present frame data fd and the previous frame data fd−1 to the present frame data fd and may be used to pre-charge the data voltage. The normal data is the same as the present frame data fd.

Hereinafter, the compensation data generated by the data compensator 420 based on the previous frame data fd−1 and the frame data of the frame prior to the previous frame is referred to as a previous compensation data fd'−1. Likewise, the compensation data generated by the data compensator 420 based on the present frame data fd and the previous frame data fd−1 is referred to as a present compensation data fd'. Each of the previous compensation data fd'−1 and the present compensation data fd' corresponds to the date of one frame.

The data compensator 420 outputs the present compensation data fd' after outputting of the previous compensation data fd'−1.

The pre-charge signal generator 430 generates a pre-charge signal PC. The pre-charge signal PC is used to indicate the output timing of a first line data ld1 of the previous frame data fd−1. The pre-charge signal PC is applied to the pre-charge data output part 440 after the output of the previous compensation data fd'−1 and before the output of the present compensation data fd' (refer to FIG. 3).

The pre-charge data output part 440 receives the first line data ld1 of the previous frame data fd−1 from the frame memory 410 in response to the pre-charge signal PC and applies the first line data ld1 of the previous frame data fd−1 to the data driver 300. In this case, the pre-charge data output part 440 outputs the first line data ld1 of the previous frame data fd−1 after the output of the previous compensation data fd'−1 and before the output of the present compensation data fd'.

Figure 3:
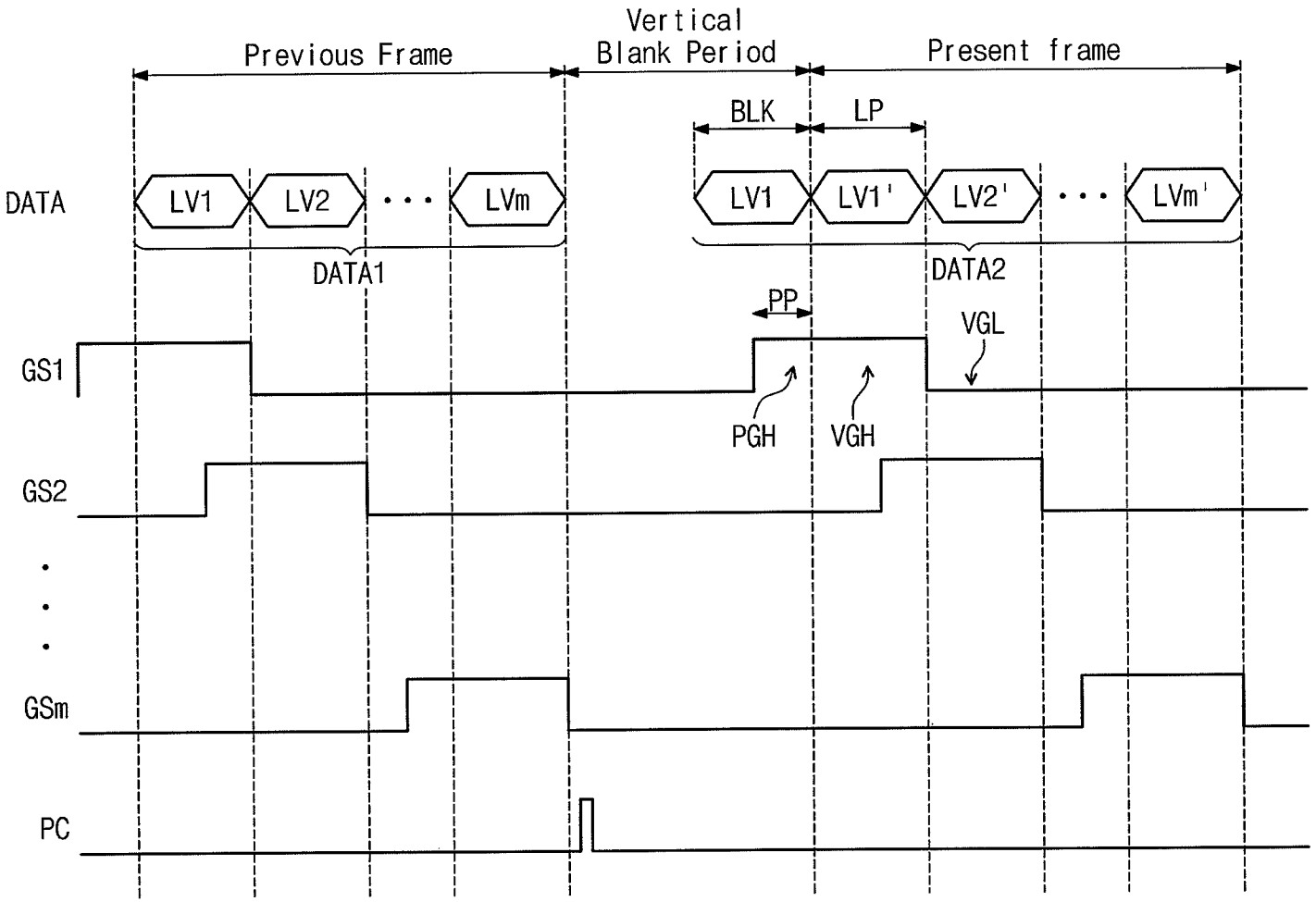
FIG. 3 is a timing diagram showing data voltages applied to data lines and gate signals applied to gate lines during a previous frame, a vertical blank period, and a present frame.

FIG. 3 is a timing diagram showing the data voltages applied to the data lines and the gate signals applied to the gate lines during a previous frame, a vertical blank period, and a present frame.

Referring to FIGS. 1 to 3, the data voltage DATA includes a previous data voltage DATA1 and a present data voltage DATA2. For example, the previous compensation data fd'−1 is converted to the previous data voltage DATA1 by the data driver 300 and applied to the data lines D1 to Dk during the previous frame period, and the present compensation data fd' is converted to the present data voltage DATA2 by the data driver 300 and applied to the data lines D1 to Dk during the present frame period.

During each of the previous frame and the present frame, first to m-th gate signals GS1 to GSm are sequentially applied to the gate lines G1 to Gm. When the first to m-th gate signals GS1 to GSm and the previous data voltage DATA1 are applied during the previous frame, the display panel 100 displays an image corresponding to the previous frame. Similarly, when the first to m-th gate signals GS1 to GSm and the present data voltage DATA2 are applied during the present frame, the display panel 100 displays an image corresponding to the present frame.

The previous data voltage DATA1 includes a plurality of previous line data voltages LV1 to LVm, which are time-sequentially arranged. In addition, the present data voltage DATA2 includes a plurality of present line data voltages LV1' to LVm', which are time-sequentially arranged. Each of the previous frame and the present frame may include a plurality of line periods LP. Each of the previous line data voltages LV1 to LVm and each of the present line data voltages LV1' to LVm' are applied to the data lines D1 to Dk during the line periods LP.

In general, a vertical blank period is inserted between the previous frame and the present frame. The vertical blank period is a delay period after the image corresponding to one frame is displayed during the previous frame and before the present frame starts. In the present exemplary embodiment, the first previous line data voltage LV1 may be applied to the data lines D1 to Dk during the vertical blank period.

The data driver 300 outputs the first previous line data voltage LV1 to the data lines D1 to Dk during a portion BLK of the vertical blank period. The first previous line data voltage LV1 corresponds to the data voltage obtained by converting the first line data ld1 of the previous frame data fd−1 provided from the pre-charge data output part 440 to a data voltage. The portion BLK of the vertical blank period is adjacent to the first line period LP of the present frame.

Each of the gate signals GS1 to GSm is configured to include the pre-charge voltage PGH, the gate high voltage VGH, and the gate low voltage VGL. The gate high voltage VGH is maintained in a high voltage state during the line period LP. The pre-charge voltage PGH is maintained in a high voltage state during a pre-charge period PP before the gate high voltage VGH. In this case, the pre-charge period PP may be smaller than the line period LP. The pre-charge period PP is adjacent to the period in which the gate high voltage VGH is applied. The pre-charge period PP of the first gate signal GS1 may at least partially overlap the portion BLK of the vertical blank period. The gate low voltage VGL is maintained in a low voltage state during a rest period of the one frame. The rest period is the portion of the one frame when the pre-charge voltage PGH and the gate high voltage VGH are not applied. As represented by the first gate signal GS1 applied during the present frame period, the gate high voltage VGH is maintained in the high voltage state during the line period LP in which the first present line data voltage LV1' is applied, the pre-charge voltage PGH is maintained in the high voltage state during the pre-charge period PP prior to the line period LP in which the first present line data voltage LV1' is applied, and the gate low voltage LP is maintained in the low voltage state during the rest period.

The gate high voltage VGH and the pre-charge voltage PGH may have the same voltage level.

The gate signals GS1 to GSm are sequentially delayed by the line period LP. For instance, the second gate signal GS2 is delayed by the line period LP when compared to the first gate signal GS1.

The high voltage states of the gate signals GS1 to GSm at least partially overlap each other by the pre-charge period PP. For example, the high voltage state of the first gate signal GS1 overlaps the high voltage state of the second gate signal GS2 by the pre-charge period PP.

The pre-charge voltage PGH is used to pre-charge the pixels. The pixels are pre-charged to the line data voltage applied to the pixels connected to the previous gate line prior to the application of the line data voltage for the pixels connected to the present gate line when the gate high voltage VGH is applied to the present gate line. For example, the second present line data voltage LV2' is applied to the pixels connected to the second gate line G2 when the gate high voltage VGH is applied to the second gate line G2. The first present line data voltage LV1' is pre-charged in the pixels connected to the second gate line G2 when the pre-charge voltage PGH is applied to the second gate line G2. The same process may be applied to the pixels connected to the third to m-th gate lines GS3 to GSm.

The pixels connected to the first gate line G1 are pre-charged with the first previous line data voltage LV1. In contrast to the pixels connected to the second to m-th gate lines G2 to Gm, the pixels connected to the first gate line G1 may not be pre-charged to the present line data voltages LV1' to LVm' of the present data voltages DATA2 since the pre-charge voltage PGH of the first gate signal GS1 is applied to the pixels connected to the first gate line G1 during the vertical blank period. The first previous line data voltage LV1 of the previous frame may have similar information to the first present line data voltage LV1'. Thus, the pixels connected to the first gate line G1 are pre-charged to the first previous line data voltage LV1.

In a typical LCD, pixels connected to the first gate line are pre-charged to a fixed data voltage or not pre-charged. This causes a defect in the brightness of images displayed by the pixels connected to the first gate line. According to at least one embodiment of the described technology, pixels connected to the first gate line are pre-charged to the first line data voltage of the previous frame according to the pre-charge voltage of the gate signal. Thus, the abovementioned defect in brightness of the displayed images may be prevented.

Although the exemplary embodiments of the described technology have been described, it is understood that the invention should not be limited to these exemplary embodiments but various changes and modifications can be made by one ordinary skilled in the art within the spirit and scope of the described technology as defined by the accompanying claims.

What is claimed is:

1. A liquid crystal display (LCD) comprising:

a display panel comprising a plurality of gate lines including a first gate line, a plurality of data lines, and a plurality of pixels, wherein each pixel is electrically connected to a corresponding gate line and a corresponding data line;

a timing controller configured to: i) receive present frame data, ii) store previous frame data, and iii) output first line data of the previous frame data;

a data driver configured to: i) receive the first line data from the timing controller, ii) convert the first line data to a first previous line data voltage, and iii) apply the first previous line data voltage to the data lines during a portion of a vertical blank period between a present frame and a previous frame; and a gate driver configured to apply a first gate signal including a pre-charge voltage, a gate high voltage, and a gate low voltage to the first gate line, wherein the gate driver is further configured to apply the pre-charge voltage during a pre-charge period at least partially overlapping the portion of the vertical blank period, wherein the pixels electrically connected to the first gate line are charged with the first previous line data voltage during the previous frame, wherein the pixels electrically connected to the first gate line are pre-charged with the first previous line data voltage during the vertical blank period, and wherein the pixels electrically connected to the first gate line are charged with a present data voltage converted from the present frame data during the present frame.

2. The LCD of claim 1, wherein the gate driver is further configured to apply the gate high voltage during a line period and wherein the pre-charge period precedes the line period.

3. The LCD of claim 2, wherein the gate driver is further configured to apply the gate high voltage and the pre-charge voltage as a high voltage and the gate low voltage as a low voltage during a rest period.

4. The LCD of claim 1, wherein the pre-charge period is shorter than the portion of the vertical blank period.

5. The LCD of claim 1, wherein the gate high voltage and the pre-charge voltage have substantially the same voltage level.

6. The LCD of claim 1, wherein the timing controller comprises:

a frame memory configured to store the previous frame data;

a pre-charge signal generator configured to generate a pre-charge signal indicating an output timing of the first line data; and a pre-charge data output part configured to receive the pre-charge signal from the pre-charge signal generator and the first line data from the frame memory.

7. The LCD of claim 6, wherein the timing controller further comprises a data compensator configured to receive the previous frame data from the frame memory and generate compensation data based at least in part on the previous frame data and the present frame data.

8. The LCD of claim 7, wherein the compensation data comprises previous frame compensation data and present frame compensation data, and wherein the pre-charge data output part is further configured to output the first line data after the previous frame compensation data is output and before the present frame compensation data is output.

9. The LCD of claim 1, wherein the data driver is further configured to pre-charge the pixels electrically connected to the first gate line with the first previous line data voltage.

10. The LCD of claim 1, wherein the gate driver is further configured to apply only one pre-charge voltage per frame.

11. A method of driving a liquid crystal display (LCD), comprising:

receiving present frame data;

storing previous frame data;

outputting first line data of the previous frame data;

converting the first line data to a first previous line data voltage;

applying the first previous line data voltage to data lines during a portion of a vertical blank period between a present frame and a previous frame; and applying a first gate signal including a pre-charge voltage, a gate high voltage, and a gate low voltage to a first gate line, wherein the pre-charge voltage is applied during a pre-charge period at least partially overlapping the portion of the vertical blank period, wherein the pixels electrically connected to the first gate line are charged with the first previous line data voltage during the previous frame, wherein the pixels electrically connected to the first gate line are pre-charged with the first previous line data voltage during the vertical blank period, and wherein the pixels electrically connected to the first gate line are charged with a present data voltage converted from the present frame data during the present frame.

12. The method of claim 11, wherein the applying of the first gate signal is performed by a gate driver, wherein the gate driver is configured to apply the gate high voltage during a line period and wherein the pre-charge period precedes the line period.

13. The method of claim 12, wherein the gate driver is further configured to apply the gate high voltage and the pre-charge voltage as a high voltage and the gate low voltage as a low voltage during a rest period.

14. The method of claim 11, wherein the pre-charge period is shorter than the portion of the vertical blank period.

15. The method of claim 11, wherein the gate high voltage and the pre-charge voltage have substantially the same voltage level.

16. The method of claim 11, pre-charging a plurality of pixels electrically connected to the first gate line with the first previous line data voltage.

17. A liquid crystal display (LCD) comprising:

a display panel comprising a plurality of gate lines including a first gate line, a plurality of data lines, and a plurality of pixels, wherein each pixel is electrically connected to a corresponding gate line and a corresponding data line;

a timing controller configured to: i) receive present frame data, ii) store previous frame data, and iii) output first line data of the previous frame data;

a data driver configured to: i) receive the first line data from the timing controller, ii) convert the first line data to a first previous line data voltage, and iii) apply the first previous line data voltage to the data lines prior to a present frame; and a gate driver configured to apply a first gate signal comprising a pre-charge voltage, a gate high voltage and a gate low voltage to the first gate line, wherein the gate driver is further configured to apply the pre-charge voltage during a pre-charge period at least partially overlapping a period during which the first previous line data voltage is applied to the data lines, wherein the pixels electrically connected to the first gate line are charged with the first previous line data voltage during the previous frame, wherein the pixels electrically connected to the first gate line are pre-charged with the first previous line data voltage during the vertical blank period, and wherein the pixels electrically connected to the first gate line are charged with a present data voltage converted from the present frame data during the present frame.

18. The LCD of claim 17, wherein the gate driver is further configured to apply the gate high voltage during a line period, and wherein the pre-charge period precedes the line period.

19. The LCD of claim 17, wherein the data driver is further configured to apply the first previous line data voltage during a portion of a vertical blank period between a present frame and a previous frame.

20. The LCD of claim 19, wherein the pre-charge period is shorter than the portion of the vertical blank period.

21. The LCD of claim 19, wherein the timing controller comprises:

a frame memory configured to store the previous frame data;

a pre-charge signal generator configured to generate a pre-charge signal indicating an output timing of the first line data; and a pre-charge data output part configured to receive the pre-charge signal from the pre-charge signal generator and the first line data from the frame memory.

22. The LCD of claim 21, wherein the timing controller further comprises a data compensator configured to receive the previous frame data from the memory and generate compensation data based at least in part on the previous frame data and the present frame data.

* * * * *